United States Patent [19]

Schermutzki

[11] Patent Number: 4,771,683

[45] Date of Patent: Sep. 20, 1988

[54] DUAL BELT PRESS WITH OBLIQUELY DISPOSED HEATING PLATE STRIPS

[75] Inventor: Konrad Schermutzki, Remseck, Fed. Rep. of Germany

[73] Assignee: Santrade Ltd., Luzerne, Switzerland

[21] Appl. No.: 86,648

[22] Filed: Aug. 18, 1987

[30] Foreign Application Priority Data

Aug. 21, 1986 [DE] Fed. Rep. of Germany ..... 3628334

[51] Int. Cl.[4] ..... B30B 3/00; B30B 15/34

[52] U.S. Cl. ..... 100/93 P; 100/153; 156/583.1; 156/583.5; 425/371; 425/406; 165/81; 165/168; 38/16

[58] Field of Search ..... 425/371, 406, 101; 38/10, 15, 16; 100/93 P, 153, 154, 222, 38, 295; 156/583.1, 583.5; 165/81, 82, 168

[56] References Cited

U.S. PATENT DOCUMENTS

| | | | |
|---|---|---|---|
| 3,317,707 | 5/1967 | Knudson et al. | 165/82 X |
| 4,164,387 | 8/1979 | Schermutzki et al. . | |
| 4,541,889 | 9/1985 | Held | 100/154 X |
| 4,565,509 | 1/1986 | De Mets . | |

FOREIGN PATENT DOCUMENTS

| | | | |
|---|---|---|---|
| 829793 | 1/1952 | Fed. Rep. of Germany . | |
| 1154255 | 9/1963 | Fed. Rep. of Germany . | |
| 1236939 | 3/1967 | Fed. Rep. of Germany . | |
| 2036926 | 11/1975 | Fed. Rep. of Germany . | |
| 2729559 | 3/1979 | Fed. Rep. of Germany . | |
| 2937972 | 2/1981 | Fed. Rep. of Germany . | |
| 3042972 | 9/1982 | Fed. Rep. of Germany . | |
| 3138011 | 4/1983 | Fed. Rep. of Germany . | |
| 2217215 | 9/1984 | Fed. Rep. of Germany . | |
| 2158130 | 6/1973 | France | 165/82 |
| 293842 | 3/1932 | Italy | 165/168 |
| 228927 | 2/1925 | United Kingdom . | |

*Primary Examiner*—Andrew M. Falik

*Attorney, Agent, or Firm*—Burns, Doane, Swecker & Mathis

[57] ABSTRACT

A dual belt press comprises a pair of endless belts forming oppositely facing press flights. The press flights are pressed toward one another by press plates, with freely rotating rollers disposed between the press flights and press plates. Each press plate comprises a support plate and a plurality of plate strips mounted on a surface of the support plate facing the associated press flight. The plate strips have longitudinal axes extending obliquely relative to the direction of travel of the press flights and obliquely relative to axes of rotation of the rollers. The plate strips are heated or cooled by a fluid traveling through conduits formed in the plate strips or clamped between adjacent plate strips.

10 Claims, 3 Drawing Sheets

FIG.1
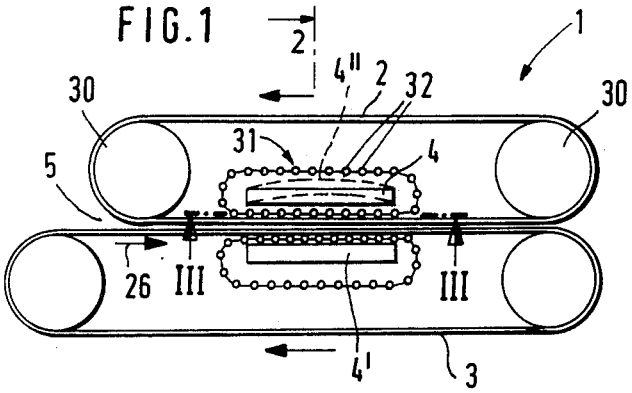
FIG.2
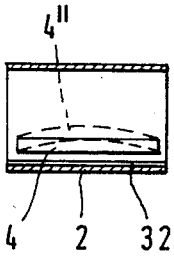
FIG.3
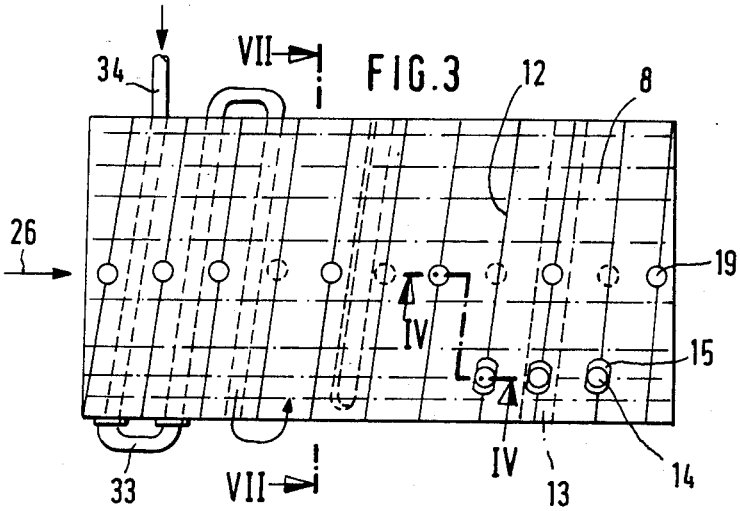
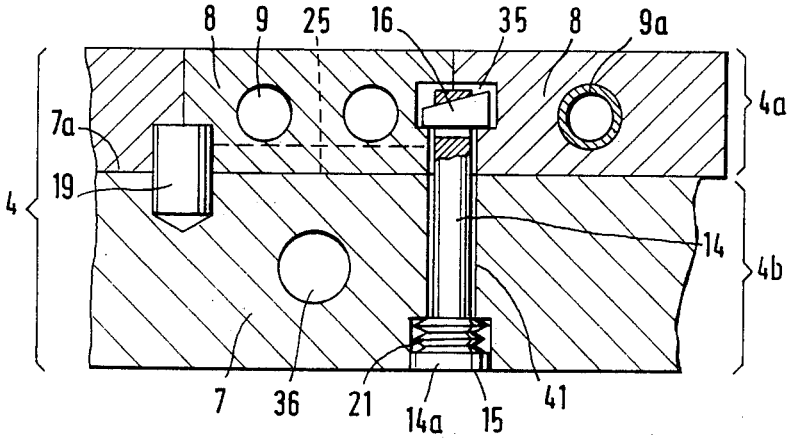
FIG.4

DUAL BELT PRESS WITH OBLIQUELY DISPOSED HEATING PLATE STRIPS

BACKGROUND AND OBJECTS OF THE INVENTION

The invention concerns a heating or cooling plate for press installations, in particular, a dual belt press.

Heating or cooling-type press plates are disclosed in German Pat. No. 27 29 559 wherein steel belts carrying the material to be pressed travel between the press plates while being supported by a plurality of rotary press rolls. The latter serve to reduce friction between the belts and the press plates, as well as to transfer heat from the press plates to the steel belts and from there to material being pressed (or, inversely, to remove heat from the material being pressed, if the plate is a cooling plate). A disadvantage of such heated or cooled dual belt presses involves the fact that the heating or cooling plates are thermally deformed by different amounts on their two sides, due to the differential heat transfer on such sides, especially if there are large differences in temperature between the material being pressed and the heating (or cooling) plate. This results in a non-uniform thickness of the material being pressed.

Accordingly, in some systems, the press plates are supported relative to the upper and lower belts of the adjacent press stand on spacing strips, which strips may be heated so that as a result of differential thermal expansions of the spacing pieces, any thermal deformation of the press plates, or any manufacturing tolerances of the press, can be compensated for.

In other systems, such as those disclosed in German Printed Application No. 11 54 255 and German Pat. No. 20 36 926, there is provided the possibility of differentially heating the upper and lower belt of the press stand of multiple platen presses, in order to obtain flat contact surfaces for the material being pressed. However, such systems have the disadvantage that the mass to be heated is very large, so that the inertia of these presses is too high for the rapid equalization of potential variations in thickness.

All of the known systems require relatively complicated heating installations operating under differential temperature controls in order to obtain the required desired.

A press disclosed in German Pat. No. 12 36 939 includes a heating plate for discontinuous pressing operations, the plate having a two layer structure. The two layers comprise a heating plate layer mounted on a support plate layer by means of threaded bolts. The bolts extend through bores in the layers and engage guides. Each guide comprises two parallel ribs which form a slot directed toward the center of the heating plate. The heating plate may therefore shift relative to the support plate due to thermal expansion and contraction. In such a configuration, the heating plate is not located, as in the case of dual belt presses, opposite a moving steel belt supported against the heating plate by a revolving roll chain, whereby frictional forces are to be reduced. The heating plate would be undesirably deformed in a dual belt press by the shear forces applied by the rolls running over the heating plate.

It is an object of the invention to provide a heating or cooling plate of the afore-mentioned type for a dual belt press so that within the plate the deformation resulting from differential thermal expansion will remain as low as possible, wherein the forces applied by the support roll chains will not lead to interference with the heating plate.

SUMMARY OF PREFERRED EMBODIMENTS OF THE INVENTION

To attain this object, the present invention involves a dual belt press comprising upper and lower press plate, upper and lower belts surrounding the press plates, and means for regulating the temperature of at least one of the press plates. The belts have mutual opposite pressing flights traveling in a common direction of movement for compressing a material disposed therebetween. Each press plate comprises a support plate, a plurality of elongated plate strips, and securing pins for securing the plate strips to the support plate. The plate strips are disposed on a surface of the support plate which faces the pressing flight of the associated belt. Each plate strip defines a longitudinal axis in the direction of elongation of the plate strip. The securing pins permit thermal expansion and contraction of the plate strips relative to the support plate in the direction of the longitudinal axis. The securing pin for each plate strip comprise a first pin and a plurality of second pins. The first pin is disposed substantially at the center of the plate strip with reference to the longitudinal axis thereof. The first pin operably engages the support plate and the plate strip in a manner resisting relative movement between the support plate and plate strip at the pin. The second pins are disposed at locations spaced longitudinally of the first pin. The second pins operatively engage the support plate and the plate strip for resisting relative movement therebetween in a direction parallel to the common direction of movement of the pressing flights, while permitting relative movement therebetween in the direction of the longitudinal axis.

As a result of this arrangement, the layer of plate strips facing the material being pressed and exposed to the highest temperature effect is able to expand or contact independently and is deformed only negligibly due to its low thickness. Deformation is further hindered since the plate strips are fastened to the adjacent support plate, the contact surface of which remains largely flat or may be maintained planar in a known manner by compensating heating. By orienting the plate strips parallel to each other and obliquely relative to the edges of the support plate, the tendency for the strip plates to deform is diminished. Because of the oblique orientation of the plate strips relative to the traveling direction of the belt, no rattling can result from the movement of the support rolls when passing over the plate strips, as the impact locations of the plate strips are not parallel to the axles of the support rolls. The risk of interference with or deformation of the heating or cooling plate strips is thereby avoided.

It is further advantageous that the heating plate strips be made of a material other than that of the support plate. The heating plate strips may thus be made of a heat-resistant material, for example, a non-scaling steel which is then hardened. The wear of the surface of the heating or cooling plate over which the rolls are constantly passing, is thereby reduced. It is also advantageous that the support plate itself be made of a less expensive material and that the heating plates may be replaced relatively simply. This readily mounted and repaired configuration is further favored by the mounting of the individual plate strips so as to clamp therebetween heating pipes.

BRIEF DESCRIPTION OF THE DRAWINGS

The objects and advantages of the invention will become apparent from the following detailed description of preferred embodiments thereof in connection with the accompanying drawings, in which like numerals designate like elements, and in which:

FIG. 1 is a schematic longitudinal section through a dual belt press equipped with a heating and/or cooling installation according to the present invention;

FIG. 2 is a cross-section through the dual belt press of FIG. 1, the section being taken only through the upper belt along the line 2 with the press rolls being removed;

FIG. 3 is a bottom plan view of the heating or cooling plate of FIG. 1 taken in the direction of the arrows III;

FIG. 4 is an enlarged view of a partial section through FIG. 3 in the direction of the arrows IV—IV;

DETAILED DESCRIPTION OF PREFERRED EMBODIMENTS OF THE INVENTION

Figure 5:
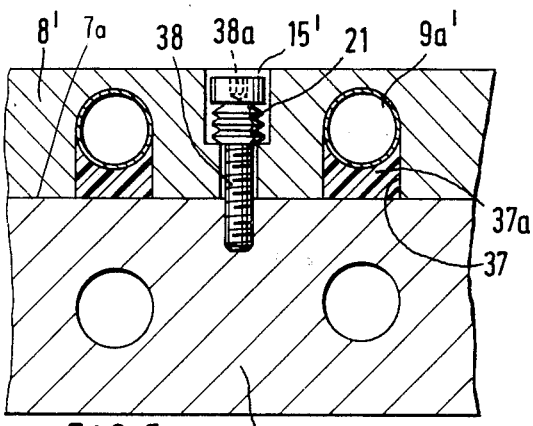
FIG. 5 is a section similar to FIG. 4, according to another embodiment of the invention.

FIGS. 1 and 2 show a dual belt press 1 comprising steel belts 2, 3 revolving in opposite directions and having their opposing flights pressured against each other by means of press plates 4, 4'. The press plates, which may comprise heating or cooling plates, are fastened to respective ones of the upper and lower press frames and are pressed toward each other. The revolving steel belts 2 and 3, respectively, are guided along the opposing faces of the press plates 4, 4'. To reduce friction, roller chains 31 are mounted in conventional fashion between the belts and their respective press plates. Each roller chain comprises rollers 32 extending transversely over the width of the belts 2 and 3, the rolls being rotatably mounted in chains. By means of these rollers, there occurs a heat transfer between the press plates and the material being pressed. If, for example, the press plates comprise heating plates, their opposing faces heat the passing rollers 32, which, in turn, transfer heat to the material 5 being pressed between the belts 2, 3. On the other hand, the rollers 32 are cooler than the opposing faces of the press plates and thus impose a cooling effect thereon. As a result, if the press plate comprised a solid member, it would tend to deform (as indicated in broken lines in FIG. 2) into the curved position 4" shown in an exaggerated fashion. If no compensation were provided for such deformation, there would result a non-uniform thickness of the product as viewed across the width of the belt.

In accordance with the present invention, that phenomenon is avoided by constructing each press plate of a relatively thick rigid support plate 7 and a plurality of thin heating or cooling plate strips 8 extending transversely on belt-facing surface 7*a* of the support plate (see FIGS. 3 and 4). These plate strips 8 have a length (long dimension) corresponding approximately to the width of the belt. However, their width in the direction 26 of the motion of the belts is significantly less. In the embodiment according to FIG. 3, these plate strips 8 include lateral edges 13 extending obliquely relative to their longitudinal edges 12, so that when the strips are fitted against each other with their longitudinal edges 12 aligned, the strips extend obliquely or slightly non-perpendicular with respect to the direction 26 of the movement of the belts. This has the advantage that, during the passage over the individual plate strips 8, no rattling will result from the movement of the rolls 32. That is, the rotary axes of the roller will be oriented at an acute angle relative to the parting lines between the plate strips, as viewed in a direction perpendicular to the plane of the plate strips. Hence, the line of contact between the rollers and the press plate will never be aligned with the edges 13.

The plate strips 8 may be provided with continuous internal channels 9 connected with each other by means of externally connected pipe bends 33. The channels extend in a spiral manner so that a heating or cooling liquid may flow through them from a common connection location 34. As indicated at the right in FIG. 4, it is also possible to cast pipes 9*a* into the plate strips, which pipes are connected in a similar fashion with a heating or cooling system.

Figure 9:
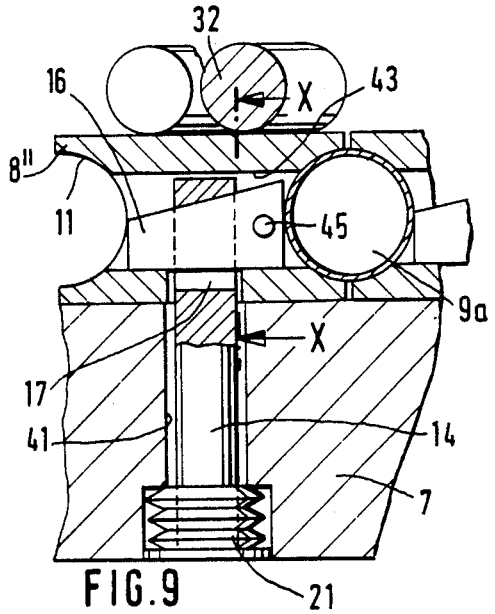
FIG. 9 is an enlarged detail of the fastening location of the heating and cooling plates similar to FIG. 4, but according to a further embodiment of the invention.
Figure 10:
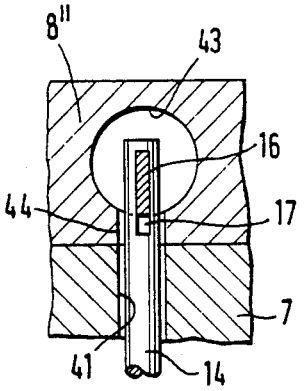
FIG. 10 is a section through FIG. 9 along the line X—X.

Each press plate 4 thus comprises an inner layer 4*a* defined by the plate strips 8 and an outer layer 4*b* defined by the support plate 7. The plate strips are mounted in such manner that they are able to undergo thermal expansion or contraction parallel to the surface 7*a* of the support plate 7. This is attained in that the centers of individual plate strips are secured by means of locating pins 19 which are aligned with a longitudinal center plane aligned with the direction 26 and passing through the plate strips. To either side of the longitudinal center plane, fastening pins in the form of bolts 14 are provided, which fastening bolts pass through the support plate 7. Heads 14*a* of the bolts 14 are engaged by flat springs 21. The bolt 14 as explained hereinbelow in connection with FIGS. 9 and 10, is provided on its side facing away from the head 14*a* with a slot through which a wedge 16 is passed. An underside of the wedge rests on a surface of a groove 35 located in the plate strips 8.

The plate strips may be installed, beginning with a plate strip held only in the center by a locating pin 19. Adjacent plate strips are installed by inserting the wedge 16 into the opening in the bolt 14 while the bolt 14 is held in a prestressed position, i.e., pressure is applied to the bolt head 14*a* until the adjacent plate strip is added. The plate strips 8, which are adjacent and both held by the wedge in the groove 35, are thus resting under a defined contact pressure against the surface of the support plate 7 as determined by the flat spring 21. The contact pressure is determined to permit thermal expansion or contraction of the plate strips. The pins 19 oppose relative movement between the plate strips and support plate in all directions. The grooves 35, however, permit relative movement of the plate strips in the direction of their lengths. Therefore, upon the occurrence of thermal differentials, the plate strips will expand or contract (primarily in the direction of their longest dimension) and to a lesser extend in their transverse direction (parallel to the direction 26). Such expansion or contraction occurs parallel to the surface 7*a* of the support plate 7.

Consequently, no appreciable thermal expansions occur which are capable of deforming the support plate 7 (and thus the press plate 4) in an undesirable manner.

It is further possible to equip the support plate 7 with flow channels 36 whereby the support plate may be heated or cooled in a known manner, to compensate for thermal expansion tendencies. The surface 7*a* of the support plate facing the plate strips may be maintained flat by heating or cooling. Finally, the plate strips 8 may also be provided on their underside with grooves 25 extending transversely to their longitudinal direction (see FIG. 4); these grooves weaken the undersides of the plate strips, thereby enhancing the possibility of a tight contact of the plate strips 8 with the support plate 7.

Figure 6:
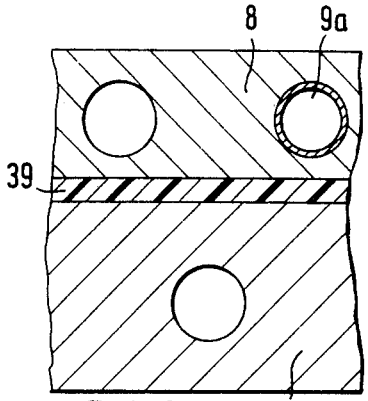
FIG. 6 is a section similar to FIG. 4, but through yet another embodiment of the invention.

FIGS. 5 and 6 each show a modified plate strip configuration. The plate strips 8′ shown in FIG. 5 are provided with longitudinal recesses 37 which are open toward the surface 7*a* of the support plate 7. The recesses are sized to receive pipes 9*a*′ which are held in place by means of a thermal insulating material 37*a*. The plate strips 8′ comprise apertures which open inwardly to receive screws 38, which are attached to the support plate 7. The heads of the screws are provided with an internal hexagon 38*a* and pressing against the plate strips 8′ through the interposition of washer springs 21.

FIG. 6 shows an arrangement wherein the plate strips 8 are equipped with cast-in pipes 9*a* (depicted in the right-half of FIG. 4). Here, however, a layer of a thermal insulating material 39 is inserted between the plate strips 8 and the support plate 7. That material is, on the one hand, able to facilitate the shifting of the plate strips 8 on the surface of the support plate 7, and on the other hand, able to prevent application of a thermal effect by the heating plate strips 8 to the support plate 7.

Figure 7:
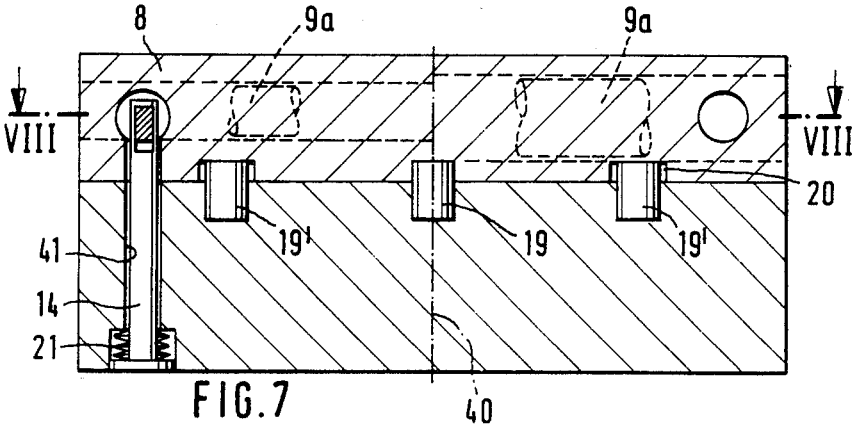
FIG. 7 is a section through the heating or cooling plate of FIG. 3 as viewed in the direction of the line VII—VII.
Figure 8:
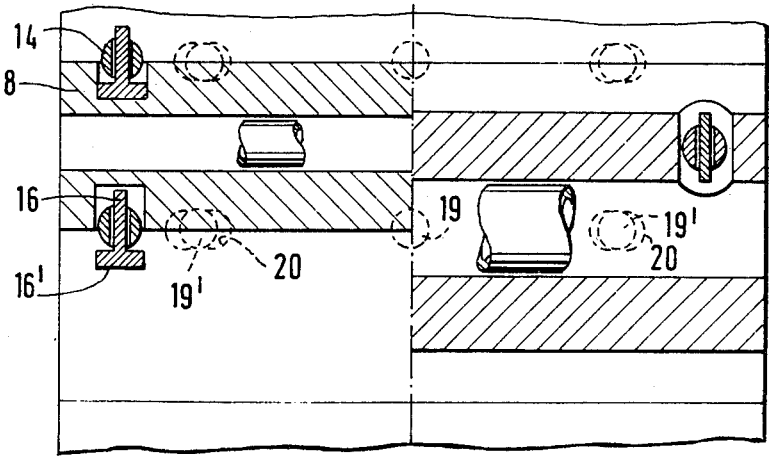
FIG. 8 is a section through FIG. 7 along the line VIII—VIII.

FIGS. 7 and 8 show a modified embodiment in which the plate strips 8 are fastened in a manner similar to FIG. 4., but wherein the locating pins 19, 19′ are distributed along the length of the plate strips. Thus, some of the locating pins 19′ are spaced from the longitudinal center plane 40 and are guided in elongated holes 20 extending transversely to the running direction 26. FIG. 8 clearly shows that the wedges 16 have T-shaped cross-sections and are provided on their rear ends with a stop part 16′ which improves the abutting of the bottom side of the wedges and serves as the stop for the passage movement of the wedge 16, which is thereby enabled to occupy a defined position relative to the bolt 14 and may be adjusted to the force of the flat springs 21. It is indicated in FIGS. 7 and 8 that it is possible to introduce pipes 9*a* with different diameters, depending on how the plate strips are laid out. In this configuration, the fastening bolts 14 must also be conducted through bores 41 to make possible their displacement in the longitudinal direction.

FIGS. 9 and 10 show that the novel heating or cooling plates may be constructed in a very simple manner by assembling the plate strips 8″ with their longitudinal edges facing each other to clamp pipes 9*a* in place. The plate strips 8″ are equipped with semicircular recesses 11 on their longitudinal edges, with always one-half of a pipe 9*a* fitting into each recess, whereby the pipe is completely framed-in by the plate strips and their recesses. Each individual plate strip 8″ is provided with a bore 43 extending transversely to the longitudinal direction of the recesses 11, which in the downward direction is aligned through an opening 44 with the bores 41 in the support plate, so that the fastening bolts 14 may be inserted from the bottom into the plate strips 8″, with the wedges 16 being inserted into the slots 17 for fixation. The wedges 16 may be provided on their broader end with a transversely located pin extension 45 to facilitate manipulation. The bottom side of the wedge 16 is resting on the bottom side of the bore 43 and insures that the plate strips 8″ are held by the force of the flat springs 21 on the support plate 7. The adjacent plate strips are placed together after the insertion of a pipe 9*a* and are secured in the above-described manner.

Figure 11:
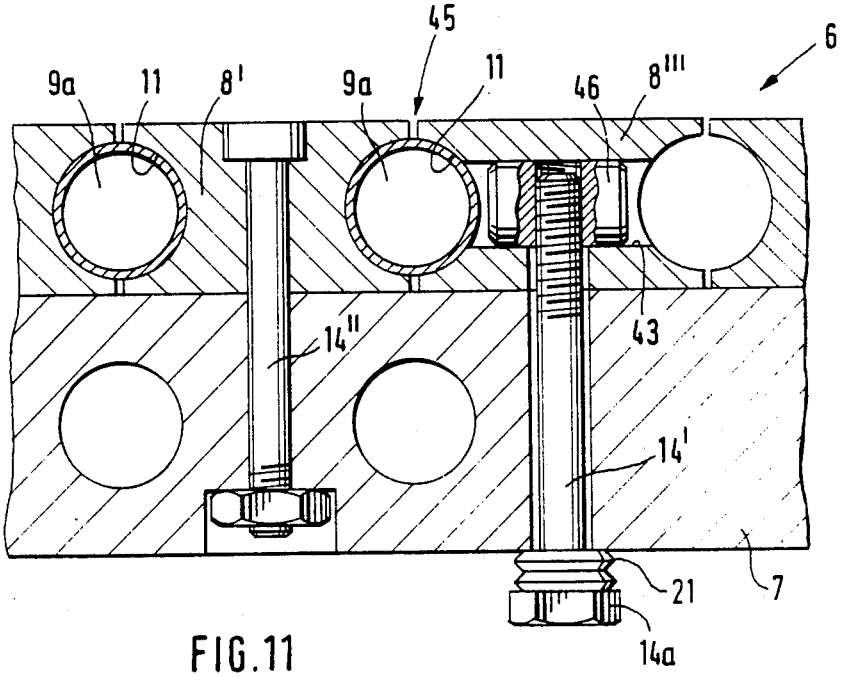
FIG. 11 is a section similar to FIG. 4 depicting a different type of fastening.

FIG. 11 shows a similar configuration where, however, the individual plate strips 8‴ are fastened not by means of wedges but by cylindrical nuts 46 held in the bores 43 in the individual plate strips 8‴ and engaged from below by a threaded bolt 14′. The head 14*a*′ of the bolt is resting against the support plate 7 with the interposition of a flat spring 21, as in earlier described embodiments. It would also be possible, as indicated in the left-half of FIG. 11, to anchor the threaded bolts 14″ not merely inside the plate strips 8′, but to arrange them such that they extend completely through both layers 7, 8 with the layers being clamped between a bolt head and a nut. The head of the threaded bolt and the nut may be countersunk in recesses. However, such a configuration has the disadvantage that the surfaces of the plate strips are not continuous but are interrupted by recesses.

In all of the embodiments, the plate strips may comprise a wear and temperature resistant steel, the surface of which may be hardened. The support plate 7 may be made of a simpler structural steel. In this manner, the zone of the heating or cooling press plate exposed to wear by the rolls rolling over it may be made more resistant. Simple dismantling for repairs is also possible.

It will be appreciated that the present invention provides an advantageous dual press belt arrangement in which the thermal expansion or contraction of the layer of plate strips is constrained to occur only in a direction extending transversely of the direction of travel of the belt. Furthermore, the cracks formed by the mutually opposing longitudinal edges of the plate strips do not create a rattling of the press rolls because those cracks are oriented obliquely relative to the axes of the rollers.

Although the present invention has been described in connection with preferred embodiments thereof, it will be appreciated by those skilled in the art that modifications, substitutions, additions, and deletions not specifically described may be made without departing from the spirit and scope of the invention as defined in the appended claims.

What I claim is:

1. A dual belt press comprising:

upper and lower press plates, upper and lower belts surrounding respective ones of said press plates and having mutually opposite pressing flights traveling in a common direction of movement for compressing a material therebetween, a plurality of freely rotatable rollers disposed between each press plate and its associated belt for transmitting force and heat from the former to the latter, said rollers each defining an axis of rotation, means for regulating the temperature of said press plates, said press plates comprising:

a support plate, a plurality of elongated plate strips disposed on a surface of said support plate facing said rollers, the longest dimensions of said plate strips disposed transversely relative to said common direction of movement, adjacent plate strips opposing one another along edges oriented obliquely relative to axes of rotation of said rollers, and securing means for securing said plate strips to said support plate for permitting thermal expansion and contraction of said plate strips relative to said support plate in the direction of said longest dimension thereof under the thermal influence of said temperature regulating means, and opposing thermal expansion and contraction of said plate strips relative to said support plate in a direction parallel to said common direction of travel.

2. A dual belt press according to claim 1, wherein said securing means for each plate strip comprises:

a first pin disposed substantially at the longitudinal center of said plate strip, said first pin operably engaging said support plate and said plate strip in a manner opposing relative movement between said support plate and said plate strip at said pin, and a plurality of second pins disposed at locations spaced longitudinally of said first pin, said second pins operably engaging said support plate and said plate strip for resisting relative movement therebetween in a direction parallel to said common direction of movement while permitting relative movement of said plate strips relative to said support plate in the direction of said longest dimension.

3. A dual belt press according to claim 2, wherein said longitudinal axes extend obliquely relative to said common direction of travel of said pressing flights.

4. A dual belt press according to claim 3, wherein said temperature regulating means comprises heat exchange means for heating or cooling said plate strips.

5. A dual belt press according to claim 4, wherein said temperature regulating means comprises conduit means in said plate strips for conducting a heat exchange fluid.

6. A dual belt press according to claim 5, wherein said conduit means comprises channels integrally formed in said plate strips.

7. A dual belt press according to claim 6, wherein adjacent plate strips include mutually facing longitudinal edges, said conduit means comprising pipes secured between said mutually facing edges.

8. A dual belt press according to claim 3, wherein said second pins comprise bolts extending through said support plate and engaging longitudinally elongated holes in said plate strips.

9. A dual belt press according to claim 8, wherein said bolts are secured by wedges disposed in portions of said bolts situated in said elongated holes.

10. A dual belt press according to claim 9 including spring means arranged to act against said bolt to urge said bolt against said wedge.

* * * * *